United States Patent [19]

Heymanns

[11] Patent Number: 4,458,853

[45] Date of Patent: Jul. 10, 1984

[54] APPARATUS FOR THE SEPARATE WINDING OF SLIT WEBS

[75] Inventor: Willi Heymanns, Kaarst, Fed. Rep. of Germany

[73] Assignee: Jagenberg AG, Dusseldorf, Fed. Rep. of Germany

[21] Appl. No.: 284,154

[22] Filed: Jul. 17, 1981

[30] Foreign Application Priority Data

Jul. 18, 1980 [DE] Fed. Rep. of Germany ..... 3027177

[51] Int. Cl.[3] ..... B65H 17/08

[52] U.S. Cl. ..... 242/56.4; 242/66

[58] Field of Search ..... 242/65, 66, 56.2, 67.3 R, 242/56.4

[56] References Cited

U.S. PATENT DOCUMENTS

| | | | |
|---|---|---|---|
| 623,795 | 4/1899 | Libert | 242/65 |
| 1,984,784 | 12/1934 | Cameron | 242/66 |
| 2,460,694 | 2/1949 | Haswell | 242/56.4 |
| 3,188,016 | 6/1965 | Aaron | 242/65 |
| 3,334,834 | 8/1967 | Davidson | 242/65 |
| 3,377,033 | 4/1968 | Link | 242/66 X |
| 3,394,897 | 7/1968 | Martin | 242/66 |
| 3,604,649 | 9/1971 | Dorfei | 242/66 |
| 3,687,388 | 8/1972 | Pfeiffer | 242/66 X |
| 3,883,085 | 5/1975 | Held | 242/65 |
| 4,266,736 | 5/1981 | Schonmeier | 242/66 |

*Primary Examiner*—Stuart S. Levy
*Assistant Examiner*—Lloyd D. Doigan
*Attorney, Agent, or Firm*—Sprung, Horn, Kramer & Woods

[57] ABSTRACT

An apparatus for the separate winding of slit webs onto at least two web rolls, comprising a pair of parallel driven rolls, a web roll bearing on each support roll at or in proximity to its uppermost generatrix, and an unloading means of adjustable force engaging the shaft of each web roll, whereby the winding force on each web can be varied as the diameter of its web roll increases.

1 Claim, 2 Drawing Figures

APPARATUS FOR THE SEPARATE WINDING OF SLIT WEBS

BACKGROUND OF THE INVENTION

The invention relates to an apparatus for the separate winding of slit webs onto at least two web rolls supported on support rolls driven in rotation.

For the winding of slit webs onto at least two web rolls, apparatuses based on two different principles are known. In a winding apparatus based on one of these principles and known from German Pat. No. 11 96 463, for example, the web rolls are supported with their axes parallel on two driven support rolls whose axes are parallel to and slightly spaced from each other. Since the web rolls bear with their entire weight on the support rolls, the pressure which they exert on the support rolls increases steadily as the web being wound builds up and becomes heavier. As a result, the outer turns of the roll being wound are subjected to an increasing mechanical load and the density of the roll increases because of the ever more pronounced roll-clearance effect, and ultimately the web may even rupture if the load becomes too great. The roll-clearance effect at two support rolls increases the load on the web still further.

In the second type of apparatus, known from U.S. Pat. No. 3,792,824, for example, two web rolls are arranged in a diametrically opposed relationship on a common support roll, these two web rolls being supported in separate axial bearings and the bearings being displaceable radially relative to the support roll as the web-roll diameter increases. In this apparatus, the weight of the web roll is absorbed by the axial bearing, and the stresses which are due to the weight of the web roll, and which increase with its diameter, act on the center of the web to bring about its rupture. That center must further absorb the horizontal forces, required for the line-contact pressure, which are externally applied by means of pressure cylinders. The vertically acting forces due to the weight and the horizontally acting forces due to the contact pressure add geometrically.

SUMMARY OF THE INVENTION

The present invention has as its object to provide a winding apparatus which is not afflicted with the described drawbacks of prior-art winding apparatuses and which in particular permits wide slit webs to be wound into large rolls evenly, that is to say, into rolls of uniform density.

This object is accomplished through an apparatus of the type outlined above.

The apparatus in accordance with the invention offers the advantage over prior-art apparatuses that in it the forces due to the weight of the web roll are distributed and the application of external forces for generation of the line-contact pressure can be dispensed with because the axial load is relieved and also because the web roll is supported on the support roll. Moreover, the adverse influence, mentioned earlier, of the roll-clearance effect is reduced since only one roll is used per web roll. Thus the web is not subject to the damage described either in the center or at the periphery of the web roll.

Preferred characteristics of the apparatus in accordance with the invention relate in part to the design of the unloading means in the form of hydraulic or pneumatic cylinder/piston or electric drive units. By combining these unloading means with sliding web-roll carriages which are adapted to be horizontally positioned on a crossbeam for different web widths, a simple and compact design is obtained. by coordinating the magnitude of the unloading with the instantaneous diameter of the web roll, in other words, through a weight reduction that is variable with time, the pressure exerted by the web roll on the support roll can be controlled to influence the density of the web roll as desired. If it were not for this expedient, the pressure of the web roll on the support roll, and with it the density of the web roll, would be increasing. What is desired, however, with a view to avoiding the formation of creases in the web roll is a roll density that decreases with increasing roll diameter. The unloading is therefore preferably increased as the web-roll diameter increases in order to gradually reduce the pressure exerted by the web roll on the support roll.

BRIEF DESCRIPTION OF THE DRAWINGS

The invention will now be described in greater detail with reference to an embodiment illustrated in the accompanying drawing, wherein.

DETAILED DESCRIPTION OF THE INVENTION

A web 2 is unwound from a supply roll 1 and by means of circular blades 3 slit into a plurality of strips 4 which then are wound up separately.

Figure 1:
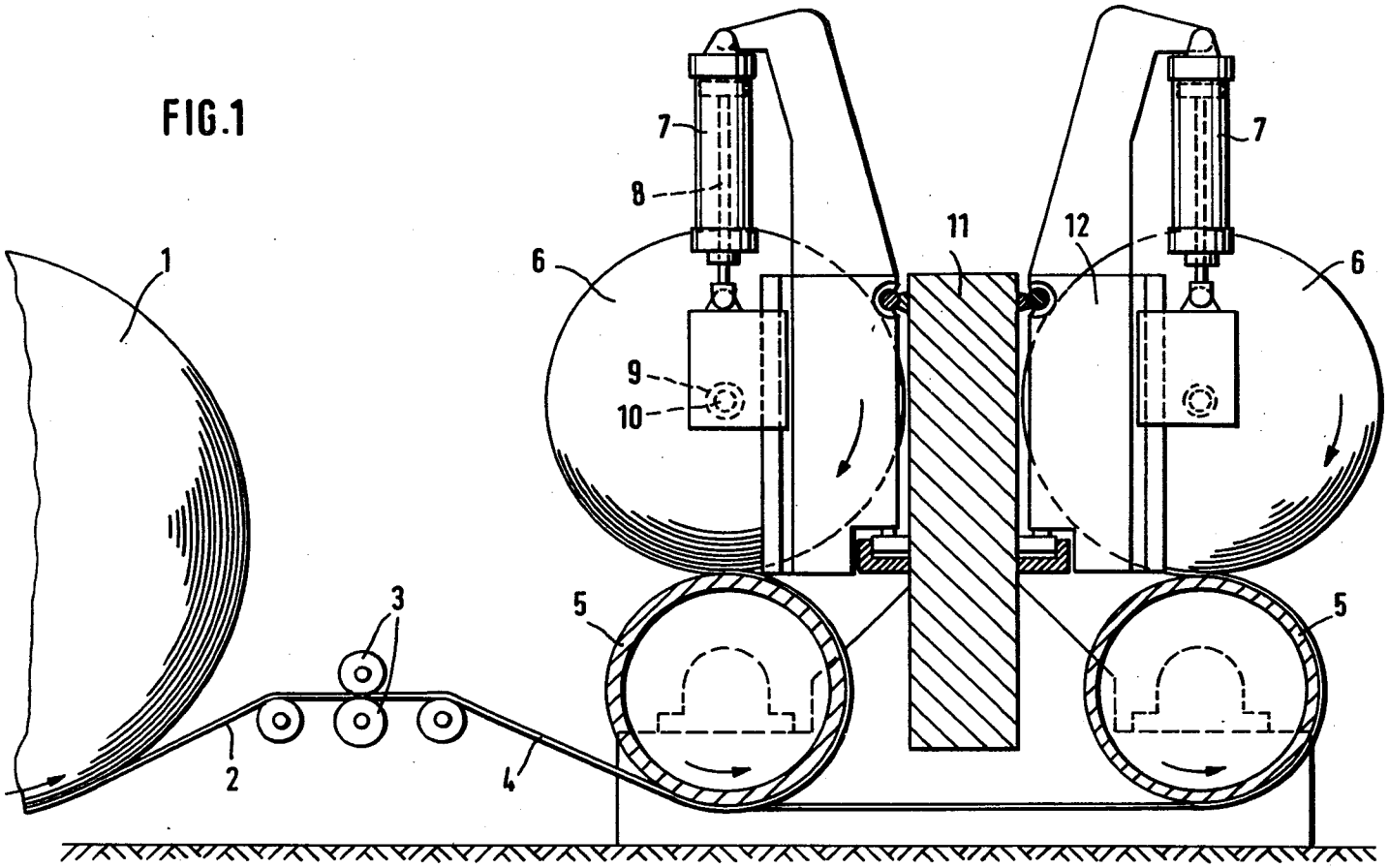
FIG. 1 is a side elevation.

The winding apparatus provided for this purpose comprises two driven support rolls 5 disposed with their axes parallel. Each of the support rolls 5 carries an individually mounted web roll 6, the axes of the support rolls 5 and of the web rolls 6 carried by them being in the same vertical plane. The directions of rotation of the roll 1, the support rolls 5 and the web rolls 6 are indicated by arrows in FIG. 1.

Two separate unloading means are provided for each web roll 6. In the embodiment shown in FIGS. 1 and 2, each of these means is formed by a pneumatic or hydraulic cylinder/piston unit 7, for example. Their piston rods 8 bring about, through a mounting plate carrying stub shafts 10 inserted on both sides into the open ends of the core tube 9, an axial unloading of the web roll 6, said unloading being continuously variable as the diameter of the web roll 6 increases so as to compensate for the increasing weight of the web roll 6 by means of the unloading means 7 and 8 in such a way that a desired line-contact pressure, which determines the density of the web roll, is obtained.

Each unloading means 7 and 8 is fastened to a sliding web-roll carriage 12 which is mounted on a crossbeam 11 for displacement along its length. The sliding web-roll carriage and the unloading means combined form a winding stand, and such winding stands are adapted to be positioned at right angles to the direction of web motion in accordance with the differing widths of the strips 4 and the different locations of the slitting means.

Figure 2:
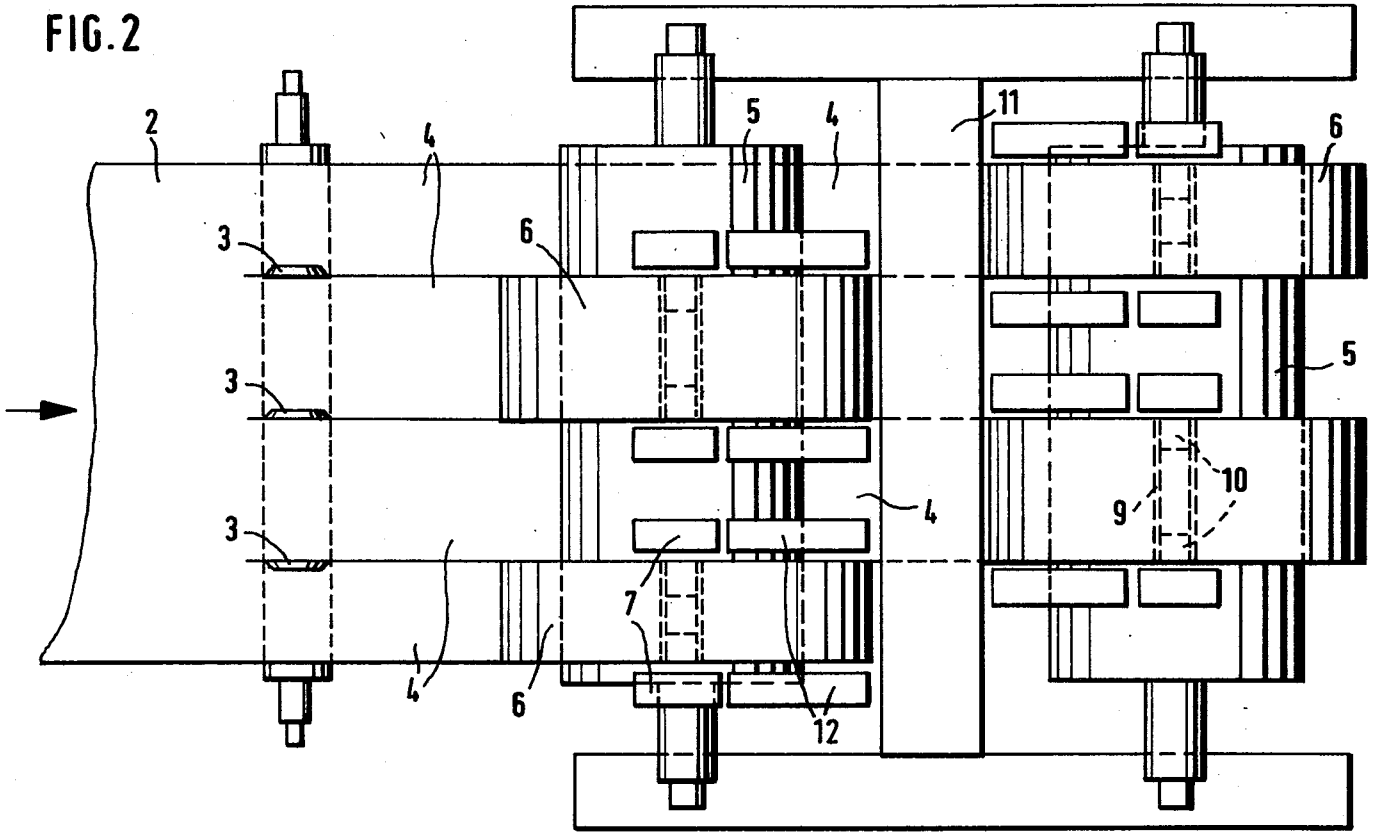
FIG. 2 is a top plan view of the apparatus in accordance with the invention incorporating provision for hydraulic or pneumatic axial unloading of the web roll.

As is apparent from FIG. 2, the strips 4 are alternately wound onto web rolls 6 on one support roll 5 and onto web rolls 6 on the other support roll 5. In this way, sufficient space is provided for the winding stands and the load on the support rolls is reduced. This allows even large-diameter web rolls to be produced.

It will be appreciated that the instant specification and claims are set forth by way of illustration and not of limitation, and that various modifications and changes may be made without departing from the spirit and scope of the present invention.

What is claimed is:

1. An apparatus for separate winding of slit web onto at least two web rolls comprising a pair of parallel driven support rolls, slitting means in line with said support roll at said support rolls uppermost generatrix, vertically oriented unloading means of adjustable force formed of a hydraulic or pneumatic cylinder/piston attached at a first end to a mounting plate, said mounting plate having stub shafts inserted into the ends of the web roll, a vertical crossbeam disposed between and parallel to the support rolls, and web roll carriages vertically mounted on each side of said crossbeam for horizontal sliding motion in accordance with the width of the slit web to be wound up, said carriages at their uppermost portion attaching to a second end of the unloading means, said carriages cooperating with said mounting plate for vertical movement of said web rolls and said mounting plate as said mounting plate is moved vertically by said unloading means wherein said carriages support said unloading means and said web rolls in a vertical plane above said support rolls whereby said unloading means can vary the pressure exerted by the web rolls on the support rolls as a function of the diameter of the web rolls.

* * * * *